US006409912B1

(12) United States Patent
Wallace et al.

(10) Patent No.: US 6,409,912 B1
(45) Date of Patent: Jun. 25, 2002

(54) INTEGRATION OF SOLVENT DEASPHALTING, GASIFICATION, AND HYDROTREATING

(75) Inventors: Paul S. Wallace, Katy; Kay Anderson Johnson, Missouri City, both of TX (US)

(73) Assignee: Texaco, Inc., White Plains, NY (US)

( * ) Notice: Subject to any disclaimer, the term of this patent is extended or adjusted under 35 U.S.C. 154(b) by 0 days.

(21) Appl. No.: 09/476,965

(22) Filed: Jan. 11, 2000

Related U.S. Application Data

(60) Provisional application No. 60/115,418, filed on Jan. 11, 1999.

(51) Int. Cl.[7] ..... C10G 45/00
(52) U.S. Cl. ..... 208/209; 208/210; 208/211
(58) Field of Search ..... 208/209, 210, 208/211

(56) References Cited

U.S. PATENT DOCUMENTS

| | | | | |
|---|---|---|---|---|
| 3,607,726 | A | 9/1971 | Hallman | 208/108 |
| 3,617,481 | A | 11/1971 | Voorhies, Jr. et al. | 208/50 |
| 4,099,382 | A | 7/1978 | Paull et al. | 60/648 |
| 4,124,486 | A | 11/1978 | Nolley, Jr. | 208/95 |
| 4,178,758 | A | 12/1979 | Paull et al. | 60/648 |
| 4,391,701 | A | 7/1983 | Le Page et al. | 208/270 |
| 5,362,382 | A | 11/1994 | Heck et al. | 208/219 |
| 5,376,258 | A | 12/1994 | Sakoda | 208/57 |
| 5,382,349 | A | 1/1995 | Yoshita et al. | 208/49 |

FOREIGN PATENT DOCUMENTS

| | | |
|---|---|---|
| DE | 1816828 | 7/1969 |
| EP | 0665281 A3 | 8/1995 |
| EP | 0665281 A2 | 8/1995 |
| WO | WO98/42804 | 10/1998 |

*Primary Examiner*—Helane E. Myers

(57) ABSTRACT

During the hydrotreating process, hydrogen sulfide and short chain hydrocarbons such as methane, ethane, propane, butane and pentane are formed. The separation of gas from hydrotreated liquid hydrocarbons is achieved using a stripper and a flash drum. High pressure steam or nitrogen is contacted with the hydrotreated liquid hydrocarbon material. This high pressure steam strips the volatiles, i.e., hydrogen, the volatile hydrocarbons, hydrogen sulfide, and the like, from the oil. The gaseous stream is then separated and cooled to remove condensables, including primarily water, short chain hydrocarbons, and hydrogen sulfide in the water. The condensables are advantageously sent to the gasifier, where the hydrocarbons are gasified, the water moderates the gasifier temperature and increases the yield of hydrogen, and where hydrogen sulfide is routed with the produced synthesis gas to the acid gas removal process.

14 Claims, 1 Drawing Sheet

INTEGRATION OF SOLVENT DEASPHALTING, GASIFICATION, AND HYDROTREATING

Priority of U.S. Provisional Application No. 60/115,418; filed Jan. 11, 1999 is claimed.

BACKGROUND OF THE INVENTION

Many crude oils contain significant quantities of asphaltenes. It is desirable to remove the asphaltenes from the oil, because asphaltenes tend to solidify and foul subsequent processing equipment, and because removal of asphaltenes lowers the viscosity of the oil.

Solvent extraction of asphaltenes is used to process residual crude that produces deasphalted oil which is subsequently catalyticly cracked and made into predominantly diesel. The deasphalting process typically involves contacting a heavy oil with a solvent. The solvent is typically an alkane such as propane to pentanes. The solubility of the solvent in the heavy oil decreases as the temperature increases. A temperature is selected wherein substantially all the paraffinic hydrocarbons go into solution, but where a portion of the resins and the asphaltenes precipitate. Because solubility of the asphaltenes is low in this solvent-oil mixture, the asphaltenes precipitate, and are separated from the oil.

Then high pressure steam or a fired heater is typically used to heat the deasphalted oil-solvent mixture to sufficient temperature. The oil portion then separates from the solvent by vaporizing solvent. The choice of solvent depends on the quality of the oil. As the molecular weight of the solvent increases, the amount of solvent needed decreases but the selectivity, for example to resins and aromatics, decreases. Propane requires more solvent but also does not extract as much aromatics and resins. Solvent recovery costs are generally greater with lower molecular weight solvents.

The extraction of asphaltenes from an asphaltene-containing hydrocarbon material with a low-boiling solvent is known. See, for example, U.S. Pat. No. 4,391,701 and U.S. Pat. No. 3,617,481, the disclosures of which are incorporated herein by reference. The deasphalting step involves contacting the solvent with the asphaltene-containing hydrocarbon material in an asphaltene extractor. It is advantageous to maintain the temperature and pressure such that the asphaltene-containing hydrocarbon material and the low-boiling solvent are fluid or fluid like. The contacting may be done in batch mode, as a continuous fluid—fluid countercurrent mode, or by any other method known to the art. The asphaltenes form solids and can be separated from the deasphalted hydrocarbon material via gravity separation, filtration, centrifugation, or any other method known to the art.

Most deasphalting solvents are recycled, and therefore generally contain a mixture of light hydrocarbons. Preferred solvents are alkanes having between three and five carbon atoms.

The deasphalted oil can easily be broken down into high-value diesel oil in a fluidized catalytic cracking unit. The deasphalted oil generally contains significant quantities of sulfur- and nitrogen-containing compounds. This deasphalted oil may also contain long chain hydrocarbons. To meet environmental regulations and product specifications, as well as to extend the life of the catalyst, the fluidized catalytic cracking unit feed is hydrotreated first to remove sulfur components.

In hydrotreating and hydrocracking operations, hydrogen is contacted with hydrocarbons typically in the presence of a catalyst. The catalyst facilitated the breaking of carbon—carbon, carbon-sulfur, carbon-nitrogen, and carbon-oxygen bonds and the bonding with hydrogen. The purpose of this operation is to increase the value of the hydrocarbon stream by removing sulfur, reducing acidity, and creating shorter hydrocarbon molecules.

An excess amount of hydrogen is present during the reaction. When the gas stream leaves the reactor, it is still primarily hydrogen. The gas stream also contains vaporized hydrocarbons, gaseous hydrocarbons such as methane and ethane, hydrogen sulfide, and other contaminants. This gas stream is treated to remove condensables and is then recycled to the hydrotreating reactor. However, by-products of the hydrotreatment reaction build up, and a purge stream must be taken off the recycled gas stream to keep the impurities from building up to concentrations that would inhibit the hydrotreating reaction.

The process and advantages of gasifying hydrocarbonaceous material into synthesis gas are generally known in the industry. Hydrocarbon materials that have been gasified include solids, liquids, and mixtures thereof. Gasification involves mixing an oxygen-containing gas at quantities and under conditions sufficient to cause the partial oxidation of the hydrocarbon material into carbon monoxide and hydrogen. The gasification process is very exothermic. Gas temperatures in the gasification reactor are often above 1100° C. (2000° F.).

Gasification of hydrocarbonaceous material, i.e., the asphaltenes and optionally other hydrocarbonaceous material, occurs in a gasification zone wherein conditions are such that the oxygen and hydrocarbonaceous material react to form synthesis gas. Gasification thereby manufactures synthesis gas which is a valuable product. The components of synthesis gas, hydrogen and carbon monoxide, can be recovered for sale or used within a refinery.

The integration of these processes has unexpected advantages.

SUMMARY OF THE INVENTION

The present invention provides a process of liquid hydrocarbon product and hydrotreater gas from a hydrotreater effluent. The process includes introducing a hydrotreater gas and a liquid hydrocarbon stream to a hydrotreater and then reacting a portion of the hydrotreater gas with the hydrocarbon stream in the hydrotreater, thereby forming a reaction mixture. This reaction mixture is removed from the hydrotreater and sent to a stripper. The gaseous phase and the fluid phase are then separated. There, steam or nitrogen is introduced, and as the stream contacts the reaction mixture, volatiles are stripped from the reaction mixture.

The hydrocarbon stream can be deasphalted oil. Deasphalting an oil is performed by contacting the oil with a light alkane solvent, and then recovering the solvent. The asphaltenes recovered during solvent extraction are advantageously gasified, producing a gas comprising hydrogen and carbon monoxide. The hydrogen gas from this gasification process is advantageously utilized in the hydrotreating process.

During the hydrotreating process, hydrogen sulfide and short chain hydrocarbons such as methane, ethane, propane, butane and pentane are formed. When the gas stream leaves the hydrotreater, it is still primarily hydrogen. The gas stream and the hydrocarbon stream also contains vaporized hydrocarbons such as methane through pentane, hydrogen sulfide, and other contaminants. This gas stream is separated from the hydrocarbon liquid, treated to remove condensables, and is then is advantageously recycled to the hydrotreating reactor.

A schematic of one embodiment of the process is shown in FIG. 1. In this embodiment, the hydrotreater gas and the liquid hydrocarbon stream are admixed prior to entering the hydrotreater. Then, after hydrotreating, steam is admixed. Some of the heat is recovered, and then the gas and fluid phases are separated. The gas is cooled and condensables are obtained. The gas remains at high pressure. Most of the gas is compressed and reintroduced to the hydrotreater.

DETAILED DESCRIPTION OF THE INVENTION

The present invention provides a process of liquid hydrocarbon product and hydrotreater gas from a hydrotreater effluent.

Hydrotreating takes place at pressures of between about 800 psi (5516 kPa) and about 3000 psi (20684 kPa), and the contaminants are dissolved in the hydrocarbon liquid. In conventional hydrotreating, the separation of contaminants from hydrotreated liquid hydrocarbons is achieved by flashing and distilling the oil from the hydrotreater.

The separation of gas from hydrotreated liquid hydrocarbons in this invention is achieved using a high pressure steam or nitrogen stripper and a flash drum. High pressure steam or nitrogen is contacted with the hydrotreated liquid hydrocarbon material. This high pressure steam strips the volatiles, i.e., hydrogen, the volatile hydrocarbons, hydrogen sulfide, and the like, from the oil.

There is significant heat available in this high pressure steam which can be recovered. One advantageous use of this heat is to heat the hydrogen-rich hydrotreater gas, the hydrocarbon stream, or both, before introducing the hydrotreater gas or the hydrocarbon stream to the hydrotreater.

The gaseous stream is then further cooled to remove condensables, including primarily water, short chain hydrocarbons, and hydrogen sulfide in the water. This stream is advantageously sent to the gasifier, where the hydrocarbons are gasified, the water moderates the gasifier temperature and increases the yield of hydrogen, and where hydrogen sulfide is routed with the produced synthesis gas to the acid gas removal process.

As used herein, the term "precipitate" in the context of precipitating asphaltenes means the asphaltene-rich material forms a second phase, which may be and is preferably a fluid or fluid-like phase. In a preferred embodiment of this invention, the precipitated asphaltene-rich material is pumped to the gasifier. A solid asphaltene-rich phase is not preferred because of handling problems.

As used herein, the term "hydrotreater" refers to the reactor volume in the hydrotreater in which most of the reaction between the hydrocarbon and hydrogen gas occurs.

As used herein, the terms "deasphalted hydrocarbon material", "deasphalted oil", and "paraffinic oil" are used interchangeably to refer to the oil soluble in the selected deasphalting solvents at the conditions selected for the deasphalting operation.

As used herein, the terms "hydrotreating", "hydrocracking", and "hydrogenation" are used interchangeably to mean reacting a hydrogen gas with a hydrocarbon mixture, wherein the hydrocarbon mixture usually contains sulfur and other undesirable components.

As used herein, the term "synthesis gas" refers to gases comprising both hydrogen gas and carbon monoxide gas in amounts in excess of about 5 mole percent each. The mole ratio of hydrogen to carbon monoxide may, but need not necessarily, be about one to one. There is often some inerts in the synthesis gas, particularly nitrogen and carbon dioxide. There are often contaminants, such as hydrogen sulfide and COS.

As used herein, the term "hydrocarbonaceous" describes various suitable gasifier feedstocks is intended to include gaseous, liquid, and solid hydrocarbons, carbonaceous materials, and mixtures thereof. Asphaltenes are a component of the feedstock to the gasifier. It is often advantageous to mix feeds. In fact, substantially any combustible carbon-containing organic material, or slurries thereof, may be included within the definition of the term "hydrocarbonaceous". Solid, gaseous, and liquid feeds may be mixed and used simultaneously; and these may include paraffinic, olefinic, acetylenic, naphthenic, asphaltic, and aromatic compounds in any proportion.

Asphaltenes in oil makes further transportation and processing of the oil difficult. To maximize the value of heavy petroleum oils, separation of the asphalt components in the oil has been practiced for years. The non-asphaltene components are recovered and sold as valuable products leaving the asphaltene component that has very little value. Asphaltenes are a hydrocarbonaceous material suitable for gasification. See, for example, U.S. Pat. No. 4,391,701, the disclosure of which is incorporated herein by reference.

The process of this invention is applicable to an asphaltene-containing hydrocarbon material. This material is usually a fluid such as an oil or a heavy oil. During the distillation of crude oil, as employed on a large scale in the refineries for the production of light hydrocarbon oil distillates, a residual oil is often obtained. The process is also applicable for this residual oil. The asphaltene-containing hydrocarbon material may even appear to be a solid, especially at room conditions. The asphaltene-containing hydrocarbon material should be at least partially miscible with the solvent at extraction temperatures.

The invention is the integration of a process of asphaltene extraction with a solvent, a process of gasification by partial oxidation, and a process of hydrotreating liquid hydrocarbons. By combining gasification with solvent deasphalting, the often unmarketable by-product asphaltenes can be converted into valuable synthesis gas.

In the solvent deasphalting process the deasphalted hydrocarbon material separated from the asphaltene-containing hydrocarbon material by liquid—liquid extraction is valuable catalytic cracker feedstock. The separated asphaltene-rich material, on the other hand, is much less valuable and is therefore ideal gasification feedstock.

The extraction of asphaltenes from an asphaltene-containing hydrocarbon material with a low-boiling solvent is known. See, for example, U.S. Pat. No. 4,391,701 and U.S. Pat. No. 3,617,481, the disclosures of which are incorporated herein by reference. The deasphalting step involves contacting the solvent with the asphaltene-containing hydrocarbon material in an asphaltene extractor. It is advantageous to maintain the temperature and pressure such that the asphaltene-containing hydrocarbon material and the low-boiling solvent are fluid or fluid like. The contacting may be done in batch mode, as a continuous fluid—fluid countercurrent mode, or by any other method known to the art. The asphaltenes form crystals and can be separated from the deasphalted hydrocarbon material via gravity separation, filtration, centrifugation, or any other method known to the art.

The process comprises contacting an asphaltene-containing hydrocarbon liquid with an alkane solvent to create a mixture. The amount of solvent is typically about 4 to about 8 parts per part on a weight basis. The temperature is typically between about 400° F. (204° C.) to about 800° F. (427° C.). The viscosity of the liquid is then reduced so that entrained solids can be removed from the mixture by, for example, centrifugation, filtering, or gravity settling. A pressurized sintered metal filter is a preferred method of separation. Then, the asphaltenes are precipitated into a separate fluid phase. The precipitation may be initiated by adding additional solvent, and/or the mixture heated, until asphaltenes precipitate into a separate phase. The substantially solids-free, i.e., less than about 150 parts per million by weight, asphaltenes are removed from the mixture. The recovered solids-free asphaltenes are subsequently gasified.

The solvent can be any suitable deasphalting solvent. Typical solvents used for deasphalting are light aliphatic hydrocarbons, i.e., compounds having between two and eight carbon atoms. Alkanes, particularly solvents that contain propane, butanes, pentanes, or mixtures thereof, are useful in this invention. The particularly preferred solvents depend on the particular characteristics of the asphaltenes. Heavier solvents are used for higher asphalt Ring and Ball softening point asphaltenes. Solvents may contain a minor fraction, i.e., less than about 20%, of higher boiling alkanes such as hexanes or heptanes.

The solvent is then recovered. Solvent recovery can be via supercritical separation or distillation. Most deasphalting solvents are recycled, and therefore generally contain a mixture of light hydrocarbons. Preferred solvents are alkanes having between three and five carbon atoms, i.e., a solvent that contains at least 80 weight percent propane, butanes, pentanes, or mixtures thereof. Because relatively low temperatures are used in the extraction (vaporization) of solvent from the deasphalted hydrocarbon material, the most preferred solvent comprises at least 80 percent by weight of propane and butanes, or at least 80 percent by weight of butanes and pentanes.

The precipitated asphaltenes are then gasified in a gasification zone to synthesis gas. The synthesis gas is prepared by partially oxidizing a hydrocarbonaceous fuel and oxygen in a reactor in proportions producing a mixture containing carbon monoxide and hydrogen in the reactor. The gasification process is exothermic and the synthesis gas is hot when leaving the gasification zone. The synthesis gas is often quenched and cooled via heat exchangers, wherein it is advantageous to generate steam. Both high pressure (or high quality) steam and low pressure (or low quality) steam can be generated sequentially. This steam can be used is the deasphalting unit too strip the colvent from the deasphalted oil and the asphalt.

The hydrocarbonaceous fuels are reacted with a reactive oxygen-containing gas, such as air, substantially pure oxygen having greater than about 90 mole percent oxygen, or oxygen enriched air having greater than about 21 mole percent oxygen. Substantially pure oxygen is preferred. The partial oxidation of the hydrocarbonaceous material is completed, advantageously in the presence of a temperature control moderator such as steam, in a gasification zone to obtain the hot partial oxidation synthesis gas. The gasification processes are known to the art. See, for example, U.S. Pat. No. 4,099,382 and U.S. Pat. No. 4,178,758, the disclosures of which are incorporated herein by reference.

In the reaction zone, the contents will commonly reach temperatures in the range of about 1,700° F. (927° C.) to 3,000° F. (1649° C.), and more typically in the range of about 2,000° F. (1093° C.) to 2,800° F. (1538° C.). Pressure will typically be in the range of about 1 atmospheres (101 kPa) to about 250 atmospheres (25331 kPa), and more typically in the range of about 15 atmospheres (1520 kPa)to about 150 atmospheres (15,199 kPa), and even more typically in the range of about 60 atmospheres (6080 kPa) to about 80 atmospheres (8106 kPa).

Synthesis gas mixtures comprise carbon monoxide and hydrogen. Hydrogen is a commercially important reactant for hydrogenation reactions. Other materials often found in the synthesis gas include hydrogen sulfide, carbon dioxide, ammonia, cyanides, and particulates in the form of carbon and trace metals. The extent of the contaminants in the feed is determined by the type of feed and the particular gasification process utilized as well as the operating conditions. In any event, the removal of these contaminants is critical to make gasification a viable process, and acid gas, i.e., hydrogen sulfide, removal is very advantageous.

As the product gas is discharged from the gasifier, it is usually subjected to a cooling and cleaning operation involving a scrubbing technique wherein the gas is introduced into a scrubber and contacted with a water spray which cools the gas and removes particulates and ionic constituents from the synthesis gas. The initially cooled gas is then treated to desulfurize the gas prior to utilization of the synthesis gas.

The acid gas removal facilities for the synthesis gas, with its amine or physical solvents, removes the acid gases, particularly hydrogen sulfide, from the mixed synthesis gas/purge gas stream. The acid gas removal facilities typically operate at lower temperatures. After the synthesis gas is cooled to below about 130° C., preferably below about 90° C., the contaminants in the gas, especially sulfur compounds and acid gases, can be readily removed.

The hydrogen sulfide, an acid gas, is easily removed from the synthesis gas. The type of fluid that reacts with the acid gas is not important. Conventional amine solvents, such as MDEA, can be used to remove the hydrogen sulfide. Physical solvents such as SELEXOL(™) and RECTIXOL(™) can also be used. The fluids may be solvents such as lower monohydric alcohols, such as methanol, or polyhydric alcohols such as ethylene glycol and the like. The fluid may contain an amine such as diethanolamine, methanol, N-methyl-pyrrolidone, or a dimethyl ether of polyethylene glycol. The physical solvents are typically used because they operate better at high pressure. The synthesis gas is contacted with the solvent in an acid gas removal contactor. Said contactor may be of any type known to the art, including trays or a packed column. Operation of such an acid removal contactor is known in the art.

It is preferred that the design and operation of the acid gas removal unit result in a minimum of pressure drop. The pressure of the synthesis gas is therefore preserved.

Hydrogen sulfide from the acid gas removal unit is routed to a sulfur recovery process.

The synthesis gas composition of a gasification reaction is typically hydrogen gas at 25 to 45 mole percent, carbon monoxide gas at 40 to 50 mole percent, carbon dioxide gas at 10 to 35 mole percent, and trace contaminants. In a steam reformed synthesis gas a typical composition is hydrogen gas at 35 to 65 mole percent, carbon monoxide gas at 10 to 20 mole percent, carbon dioxide gas at 30 to 60 mole percent, and trace contaminants. These ranges are not absolute, but rather change with the fuel gasified as well as with gasification parameters.

A hydrogen-rich hydrotreater gas is advantageously extracted from the synthesis gas. This hydrogen-rich hydrotreater gas should contain at least 80 mole percent, preferably more than 90 mole percent, and more preferably more than 95 mole percent hydrogen gas. The synthesis gas enters a gas separation unit, such as a membrane designed to allow hydrogen molecules to pass through but to block larger molecules such as carbon monoxide. The membrane can be of any type which is preferential for permeation of hydrogen gas over carbon dioxide and carbon monoxide. Many types of membrane materials are known in the art which are highly preferential for diffusion of hydrogen compared to nitrogen. Such membrane materials include those composed of silicon rubber, butyl rubber, polycarbonate, poly(phenylene oxide), nylon 6,6, polystyrenes, polysulfones, polyamides, polyimides, polyethers, polyarylene oxides, polyurethanes, polyesters, and the like. The membrane units may be of any conventional construction, and a hollow fiber type construction is preferred.

A hydrogen rich gas permeate gas through the membrane. The permeate experiences a substantial pressure drop of between about 500 psi (3447 kPa) to about 700 psi (4826 kPa) as it passes through the membrane. This hydrogen rich gas is then heated and compressed as necessary and at least a portion is sent to the hydrotreater as hydrogen-rich hydrotreater gas.

The deasphalted oil has previously been separated from an asphaltene-containing material, i.e., a heavy crude, through solvent extraction. The bottoms from the extraction, the asphaltenes, were gasified to generate hydrogen, power, steam, and synthesis gas for chemical production. The deasphalted oil can be processed into a source of high-value diesel oil in a fluidized catalytic cracking unit. The deasphalted oil generally contains significant quantities of sulfur- and nitrogen-containing compounds. This deasphalted oil may also contain long chain hydrocarbons. To meet environmental regulations and product specifications, as well as to extend the life of the catalyst, the fluidized catalytic cracking unit feed is hydrotreated first to remove sulfur components.

During hydrotreating, hydrogen is contacted with a hydrocarbon mixture, optionally in the presence of a catalyst. The catalyst facilitated the breaking of carbon—carbon, carbon-sulfur, carbon-nitrogen, and carbon-oxygen bonds and the bonding with hydrogen. The purpose of hydrotreating is to increase the value of the hydrocarbon stream by removing sulfur, reducing acidity, and creating shorter hydrocarbon molecules.

The pressure, temperature, flowrates, and catalysts required to complete the hydrogenation reactions are known to the art. Typical conditions of the thermal hydrocracking are as follows: the reaction temperature of about 300° C. to about 480° C.; the partial pressure of hydrogen of about 30 kg per square centimeter to about 200 kg per square centimeter; the liquid space velocity of about 0.1 per hour to 2.0 per hour. Catalysts may be advantageously added, often at about 0.01 to 0.30 weight per weight of fluid.

Hydrotreating is most effective when the hydrocarbon mixture is contacted with relatively pure hydrogen. Hydrotreating requires a hydrogen-rich gas comprising greater than about 80 mole percent, of hydrogen gas. The hydrotreating creates volatile hydrocarbons, volatile sulfur- and nitrogen-containing hydrocarbons, hydrogen sulfide, and other gaseous contaminants. Nevertheless, the gas fraction of the fluid leaving the hydrotreater is predominantly hydrogen. This gas is advantageously recycled to the hydrotreater.

This gas stream is separated from the hydrocarbon liquid, treated to remove condensables, and is then recycled to the hydrotreating reactor. Hydrotreating takes place at pressures of between about 800 psi (5516 kPa) and about 3000 psi (20684 kPa), and at least a fraction of the contaminants are dissolved in the hydrocarbon liquid. In conventional hydrotreating, the separation of contaminants from hydrotreated liquid hydrocarbons is achieved by flashing and distilling the oil from the hydrotreater.

The separation of gas from hydrotreated liquid hydrocarbons is advantageously achieved using a high pressure steam stripper and a flash drum. High pressure steam is contacted with the hydrotreated liquid hydrocarbon material. Contacting is advantageously countercurrent utilizing a contacting tower such as is known to the art, i.e., a packed tower, a tray tower, or any other contactor. This high pressure steam strips the volatiles, i.e., hydrogen, the volatile hydrocarbons, hydrogen sulfide, and the like, from the oil.

This high temperature steam may be 400 psi (2758 kPa) to about 1500 psi (10342 kPa) steam. This is the pressure at which the steam is saturated. The steam should not readily condense in the hydrocarbon liquid. The steam and entrained contaminants is then separated from the hydrocarbon liquid by any conventional means, such as by gravity separation.

Nitrogen can also be used in place of steam. The advantage of nitrogen is that nitrogen is often mixed with fuel gas as a diluent in the combustion turbine. Since the ultimate use of the overheadgas is fuel in the turbine, nitrogen can be used as the stripping medium. An additional advantage is that nitrogen does not form an undesirable by product as does stem which forms sour water upon condensation.

The gaseous stream is then further cooled to remove condensables, including primarily water, short chain hydrocarbons, and hydrogen sulfide in the water. The cooling may further utilize remaining heat in the steam. The cooling may also include contacting water, or air-fan cooling, or both. The gaseous overhead will condense to form two phases on cooling. Removing condensables requires cooling the hydrotreater effluent gas to between about 0° and about 100° C., preferably to between about 0° C. and about 30° C. The result is a liquid steam comprising water, short chain hydrocarbons, and hydrogen sulfide. The gas stream is comprised of hydrogen gas, short chain hydrocarbons, and hydrogen sulfide.

The liquid stream is advantageously sent to the gasifier, where the hydrocarbons are gasified, the water moderates the gasifier temperature and increases the yield of hydrogen, and where hydrogen sulfide is routed with the produced synthesis gas to the acid gas removal process. This stream is advantageously heated and admixed with the asphaltene stream, where due to its temperature and to the presence of short chain hydrocarbons it reduces the viscosity of the asphaltenes. This allows the asphaltene stream to be more easily handled. Maintaining the asphaltenes as a pumpable fluid or slurry in deasphalted hydrocarbon material will ease handling problems normally associated with asphaltenes. Other hydrocarbonaceous materials from other sources may be gasified with the asphaltenes. For example, waste hydrocarbons, heavy oils, coal and tars may be gasified with the asphaltenes. If these other materials cannot be mixed with the asphaltene-rich material because the addition of these other materials does not result in a pumpable material, the additional feed would be beneficially injected into the gasifier separately.

The gaseous stream is advantageously heated and sent back to the hydrotreater. However, non-condensable by-products of the hydrotreatment reaction build up, and a purge stream must be taken off the recycled gas stream to keep the impurities from building up to concentrations that would inhibit the hydrotreating reaction. This purge gas is advantageously admixed with the synthesis gas for subsequent processing or use.

Water from condenser sprays and stripping steam also contaminate the short chain hydrocarbons. These contaminants must be removed from the hydrotreated deasphalted oil prior to cracking in the fluidized catalytic cracking unit.

DESCRIPTION OF THE DRAWING

The drawing is a schematic of one embodiment of the invention.

Hydrogen-rich gas from the gasifier is provided by line 10. This gas is compressed in compressor 12, and is conveyed via line 14 to the point where it is commingled with recycled gas from line 16. The commingled gas travels via line 18 to a heat exchanger 20, and then to a point where it is commingled with deasphalted oil from line 24. The mixture then passes through a heat exchanger 25 where it is heated by the outlet of the hydrotreater. The heated mixture then travels via line 28 to the hydrotreater 30, and exits the hydrotreater via line 32. The mixture then enters the hydrotreater 34. This entire mixture, travels via line 36 through the heat exchanger 25 where some heat is lost. The mixture then continues via line 38 to a high temperature separator 40. The bottoms are a diesel-like oil that exits via line 62 and is stripped in the separator 64 using steam or nitrogen from line 70. The bottoms from separator 64 that exit via line 66 is product oil that may undergo further processing. Water in the top gas from separator 68 is cooled using heat exchanger to condense the water. The mater is separated in drain 80 and can be used in the gasifier as a moderator. The gas in line 85 may have further treatment or may be used as fuel. The gas exiting the separator 40 enters the heat exchanger 20 where it is cooled. Water is then conveyed via line 44 to cooler 46 where it dilutes acids that could corrode the condensor, and then via line 48 to cooler 50. This results in two phases, which are conveyed via line 52 to the separator 54. The bottoms from this separator are conveyed via line 62 to stripper 64 and thereafter to the asphaltene material being sent to the gasifier (not shown). The gas exiting separator 54 via line 56 is split, with a fraction described as purge gas being conveyed to the synthesis gas treatment facilities via line 66. Another portion is conveyed via line 60 to the compressor 72 where the gas is compressed and then conveyed via line 16 to the point where it is commingled with hydrogen-rich gas from the gasifier in line 14.

Figure 1:
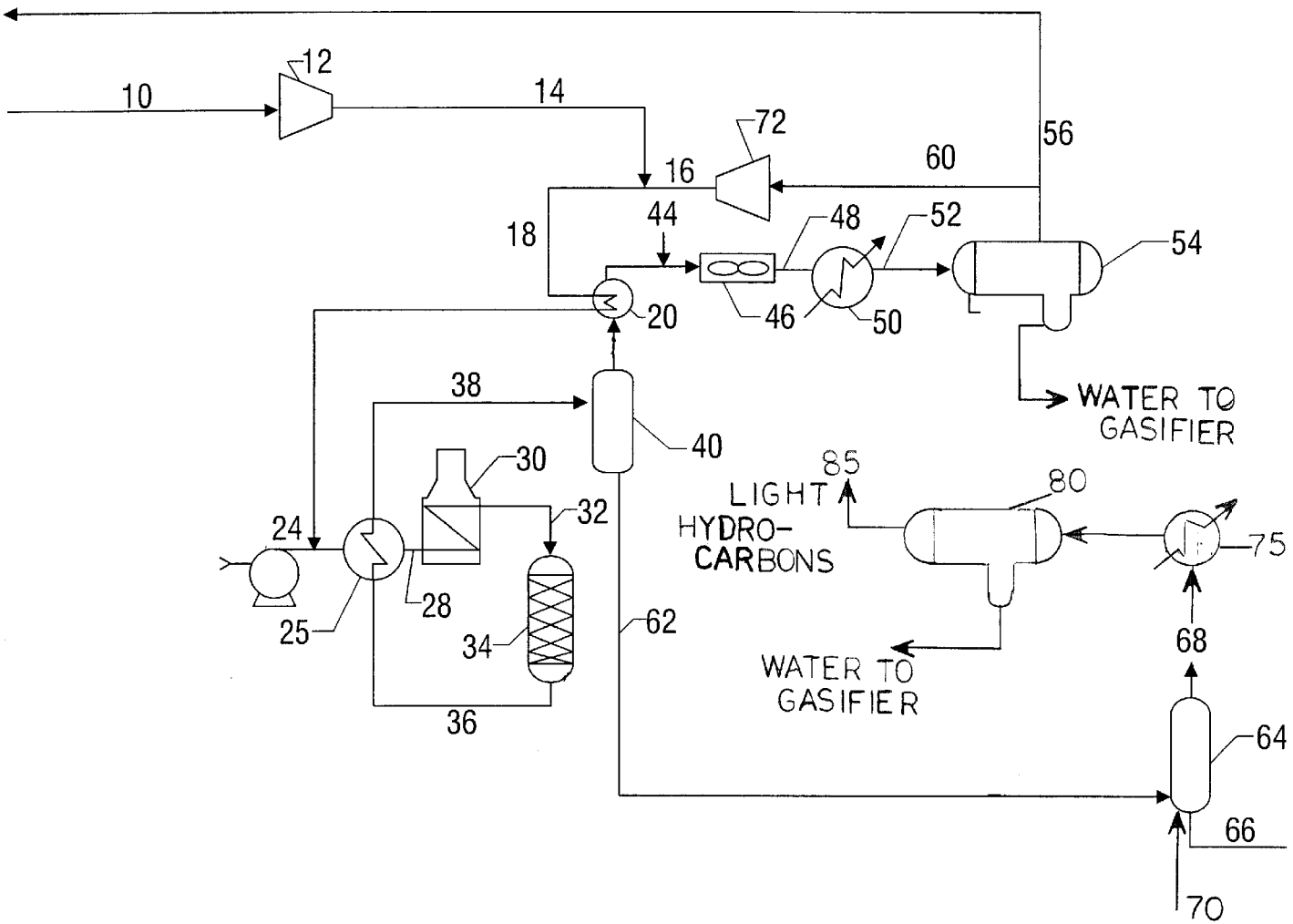

In view of the above disclosure, one having ordinary skill in the art should appreciate and understand that the present invention includes a process of hydrotreating a hydrocarbon stream in a hydrotreater and then recovering the products. In such an illustrative embodiment the process includes:

a) introducing a hydrotreater gas and a hydrocarbon stream to a hydrotreater;

b) reacting a portion of the hydrotreater gas with the hydrocarbon stream in the hydrotreater, thereby forming a reaction mixture;

c) removing the reaction mixture from the hydrotreater;

d) stripping the reaction mixture with steam or nitrogen; and e) separating the reaction mixture into a gaseous and a fluid phase.

The illustrative process is preferably carried out using a hydrocarbon stream that includes a deasphalted oil, a deasphalted heavy oil, a deasphalted residual oil, or a mixture thereof. Further it is preferred that the hydrotreater gas include at least about 80 mole percent hydrogen gas. The reaction mixture is preferably at a pressure of from about 800 psi (5516 kPa) to about 3000 psi (20684 kPa) and a temperature from about 300° C. to about 480° C. The illustrative process is preferably carried out such that the steam is provided at a steam saturation pressure of between about 400 psi (2758 kPa) to about 1500 psi (12342 kPa).

The illustrative process may further include cooling the admixed steam and reaction mixture prior to separating the reaction mixture into a gaseous and a fluid phase, wherein at least a fraction of the heat recovered is used to heat the hydrocarbon stream, the hydrotreater gas, or both, prior to introducing the hydrotreater gas and the hydrocarbon stream to a hydrotreater. It is contemplated that the process may include cooling the gaseous stream to remove condensables, wherein said cooling is performed after the gaseous phase has been separated from the fluid phase. Preferably, the gaseous phase is cooled to a temperature between about 0° C. and about 100° C. and more preferably to a temperature between about 0° C. and about 30° C. The condensables may include water, short chain hydrocarbons, and hydrogen sulfide. The illustrative process may also further include gasifying the condensables in a gasifier.

In the illustrative embodiments of the present invention, a hydrocarbonaceous material may be provided that includes asphaltenes, heating the condensables, admixing the condensables with the asphaltenes, and gasifying the mixture in a gasifier.

While the compositions and methods of this invention have been described in terms of preferred embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A process of hydrotreating a hydrocarbon stream in a hydrotreater and then recovering the products, said process comprising:

a) introducing a hydrotreater gas and a hydrocarbon stream to a hydrotreater;

b) reacting a portion of the hydrotreater gas with the hydrocarbon stream in the hydrotreater, thereby forming a reaction mixture;

c) removing the reaction mixture from the hydrotreater;

d) stripping the reaction mixture with steam or nitrogen; and e) separating the reaction mixture into a gaseous and a fluid phase.

2. The process of claim 1 wherein the hydrocarbon stream comprises a deasphalted oil, a deasphalted heavy oil, a deasphalted residual oil, or a mixture thereof.

3. The process of claim 1 wherein the hydrotreater gas comprises at least about 80 mole percent hydrogen gas.

4. The process of claim 1 wherein the reaction mixture is at a pressure of from about 800 psi (5516 kPa) to about 3000 psi (20684 kPa).

5. The process of claim 1 wherein the reaction mixture is at a temperature from about 300° C. to about 480° C.

6. The process of claim 1 wherein the steam or nitrogen is provided at a steam saturation pressure of between about 400 psi (2758 kPa) to about 1500 psi (12342 kPa).

7. The process of claim 1 further comprising cooling the admixed steam and reaction mixture after separating the reaction mixture into a gaseous and a fluid phase.

8. The process of claim 1 further comprising cooling the gaseous stream to remove condensables, wherein said cooling is performed after the gaseous phase has been separated from the fluid phase.

9. The process of claim 8 wherein the gaseous phase is cooled to between about 0° C. and about 100° C.

10. The process of claim 8 wherein the gaseous stream is cooled to between about 0° C. and about 30° C.

11. The process of claim 8 wherein the condensables are comprised of water, short chain hydrocarbons, and hydrogen sulfide.

12. The process of claim 8 further comprising gasifying the condensables in a gasifier.

13. The process of claim 12 further comprising providing a hydrocarbonaceous material that is comprised of asphaltenes, heating the condensables, admixing the condensables with the asphaltenes, and gasifying the mixture in a gasifier.

14. The process of claim 8 further comprising admixing at least part of the gaseous phase as hydrotreater gas.

* * * * *